United States Patent [19]

Bosa

[11] 4,031,001

[45] June 21, 1977

[54] ELECTROLYTIC CELL FOR THE PRODUCTION OF ALKALI METAL HYDROXIDES HAVING REMOVABLE ORIFICES FOR METERING FLUIDS TO THE ANODE AND CATHODE COMPARTMENTS

[75] Inventor: Primo Bosa, Vancouver, Canada

[73] Assignee: Hooker Chemicals & Plastics Corporation, Niagara Falls, N.Y.

[22] Filed: Aug. 29, 1975

[21] Appl. No.: 608,956

[52] U.S. Cl. ..... 204/257; 204/229; 204/263; 204/269; 204/275

[51] Int. Cl.[2] ..... C25B 1/26; C25B 9/00; C25B 15/08

[58] Field of Search ..... 204/275, 301, 279, 306, 204/252, 269, 255, 257, 263, 229, 256, 266; 136/86 R

[56] References Cited

UNITED STATES PATENTS

| | | | |
|---|---|---|---|
| 2,075,688 | 3/1937 | Zdansky | 204/256 |
| 2,282,058 | 5/1942 | Hunter et al. | 204/256 |
| 2,666,028 | 1/1954 | Silsby, Jr. | 204/266 |
| 3,076,754 | 2/1963 | Evans | 204/275 X |
| 3,220,941 | 11/1965 | Osborne | 204/266 X |
| 3,287,251 | 11/1966 | Horne et al. | 204/275 X |
| 3,331,704 | 7/1967 | Vickers et al. | 136/86 R |
| 3,405,051 | 10/1968 | Crane | 204/269 |
| 3,421,996 | 1/1969 | Coval et al. | 204/263 X |
| 3,589,941 | 6/1971 | Eaton et al. | 136/86 R |
| 3,660,259 | 5/1972 | Danly et al. | 204/263 X |

*Primary Examiner*—Arthur C. Prescott
*Attorney, Agent, or Firm*—Peter F. Casella; Herbert W. Mylius

[57] ABSTRACT

Removable orifice defining members for improving conventional electrolytic cells of the type where fluid is fed into individual anode and cathode compartments by separate fluid supply headers. The removable orifice defining members are elongated and threadedly located in orifice receiving apertures extending through the headers and communicating with the individual anode and cathode compartments. The members each include an appropriate orifice extending generally longitudinally therethrough for properly metering fluid flow from the headers into the associated compartment. The orifice defining members may be conveniently installed or removed from outside the cell structure and separate end caps are also provided for conveniently closing the outermost ends of the orifice receiving apertures.

12 Claims, 5 Drawing Figures

14

ELECTROLYTIC CELL FOR THE PRODUCTION OF ALKALI METAL HYDROXIDES HAVING REMOVABLE ORIFICES FOR METERING FLUIDS TO THE ANODE AND CATHODE COMPARTMENTS

BACKGROUND OF THE INVENTION

The present invention relates to apparatus which is particularly adaped for use in the electrolytic production of alkali metal hydroxide. More particularly, the instant invention is useful in electrolytic cells which are particularly suited for the production of chlorine and caustic and will be described with particular reference thereto; however, it will be appreciated by those skilled in the art that the invention has broader applications and may be employed in other environments.

Chlorine and caustic are commonly produced by the electrolysis of brine and details of the specific apparatus utilized for this purpose vary. However, the bulk or majority of chlorine and caustic produced in the world today is produced by means of either what is commonly referred to as the mercury cell and/or what is commonly referred to as the diaphragm cell. Both of these types of cells are deemed well known in the art.

In the diaphragm cell, chlorine and caustic are produced by passing electric current between an anode and a cathode which are separated from each other by a diaphragm. Conventionally, the anode is comprised of graphite while the cathode is fabricated from steel. In addition, the diaphragm normally comprises an asbestos base material.

Recently, such cells have been greatly improved by incorporating therein dimensionally stable anodes. Such anodes have been made by depositing noble metals, alloys, oxides or mixtures thereof on a valve metal. Further, the asbestos diaphragm has been replaced with a permselective membrane. Typical of such membranes are those fashioned from a hydrolyzed copolymer of a perfluorinated hydrocarbon and a fluorosulfonated perfluorovinyl ether.

The above referred to innovations have significantly enhanced the electrical operating efficiency of conventional diaphragm cells. However, in addition, further efficiency in their operation has been realized by modifying the general physical structure of these cells and it is with regard to certain of these latter modifications that the subject invention is directed.

Specifically, one type of modified diaphragm cell includes at least two juxtapositioned cell modules having a permselective membrane member positioned therebetween. Each of the cell modules includes a housing, an anode, a cathode and a fluid impermeable web member positioned between the anode and cathode members to form, respectively, individual anode and cathode compartments. The housing includes a first header communicating with the supplying fluid or liquid to the anode compartment and a second header communicating with and supplying fluid or liquid to the cathode compartment. Fluid can be metered into the anode and/or cathode compartments via their respective headers. Each cell module is also provided with convenient means for removing the resultant products of electrolysis therefrom.

In operation, a plurality of the cell modules are employed with each juxtapositioned cell module separated from the other by means ofa permselective membrane. Electrolysis of the appropriate fluid or liquid brine is then effected between the anode of one cell module and the cathode of the next cell module. Since the general operational and constructional features of the foregoing type of cell are known to those skilled in the art, specific means of activation and operation will not be discussed herein in detail.

While electrolytic cells of the foregoing type have performed adequately in some circumstances, one serious problem has been encountered during cell operation. This problem relates to the fact that the areas of communication between the headers and the cathode and anode compartments have become blocked. Typically, these areas of communication merely comprise small openings or orifices extending between the headers and compartments. Because of their small size location within the cells, it is both difficult and time consuming to clear the openings once they have become blocked. Since the headers and cell module housings are often times integrally cast or formed, it becomes necessary to disassemble and/or replace portions of an entire electrolytic cell. Obviously, this necessity is extremely undesirable if continuous efficient cell operation is to be achieved.

The present invention contemplates a new and improved structure which overcomes the above referred to problems and others and provides a new and improved removable orifice structure which is simple, economical, easily and positively removed from a cell structure for cleaning or replacement purposes and which is readily adaptable to use in a number of different environments.

BRIEF DESCRIPTION OF THE PRESENT INVENTION

The present invention is directed to an improvement for an electrolytic cell of the type which typically includes at least a pair of juxtapositioned cell modules each including a housing having an anode and a cathode disposed thereon which are separated by a fluid impermeable web member for establishing separate anode and cathode compartments. The housing also includes a first header for supplying fluid to the anode compartment and a second header for supplying fluid to the cathode compartment. The improvement of the subject invention generally comprises providing the housing with a first aperture communicating between the first header and the anode compartment and a second aperture communicating between the second header and the second cathode compartment for releasably receiving, respectively, a first member having a first orifice and a second member having a second orifice. The orifices effectively meter fluid or liquid flow into the anode and cathode compartments to achieve the desired continuity of cell operation.

In accordance with another aspect of the present invention, the first and second orifices pass generally longitudinally through the first and second members with each member including a body portion adapted to be releasably retained in an associated aperture and a neck portion penetrating the associated anode or cathode compartment.

In accordance with a more limited aspect of the present invention, the first aperture extends from the outermost surface of the housing and generally transversely through the first header into the anode compartment and the second aperture extends from the outermost surface of the housing and generally transversely through the second header into the cathode compartment. End caps are also provided for selectively closing the first and second apertures from the outermost surfaces thereof.

The principal object of the present invention is the provision of removable orifice defining members for metering fluid flow into the anode and cathode compartments of an electrolytic cell.

Another object of the present invention is the provision of removable orifice defining members which are simple in design and easy to manufacture.

Still another object of the present invention is the provision of removable orifice defining members which are easily and positively removed and/or installed from outside the cell structure.

Further objects of the invention will become apparent to those skilled in the art from a reading and understanding of the following description and claims.

BRIEF DESCRIPTION OF THE DRAWINGS

The invention may take physical form in certain parts and arrangements of parts, a preferred embodiment of which will be described in detail in the specification and illustrated in the accompanying drawings which form a part hereof and wherein.

DESCRIPTION OF THE PREFERRED EMBODIMENT

Figure 1:
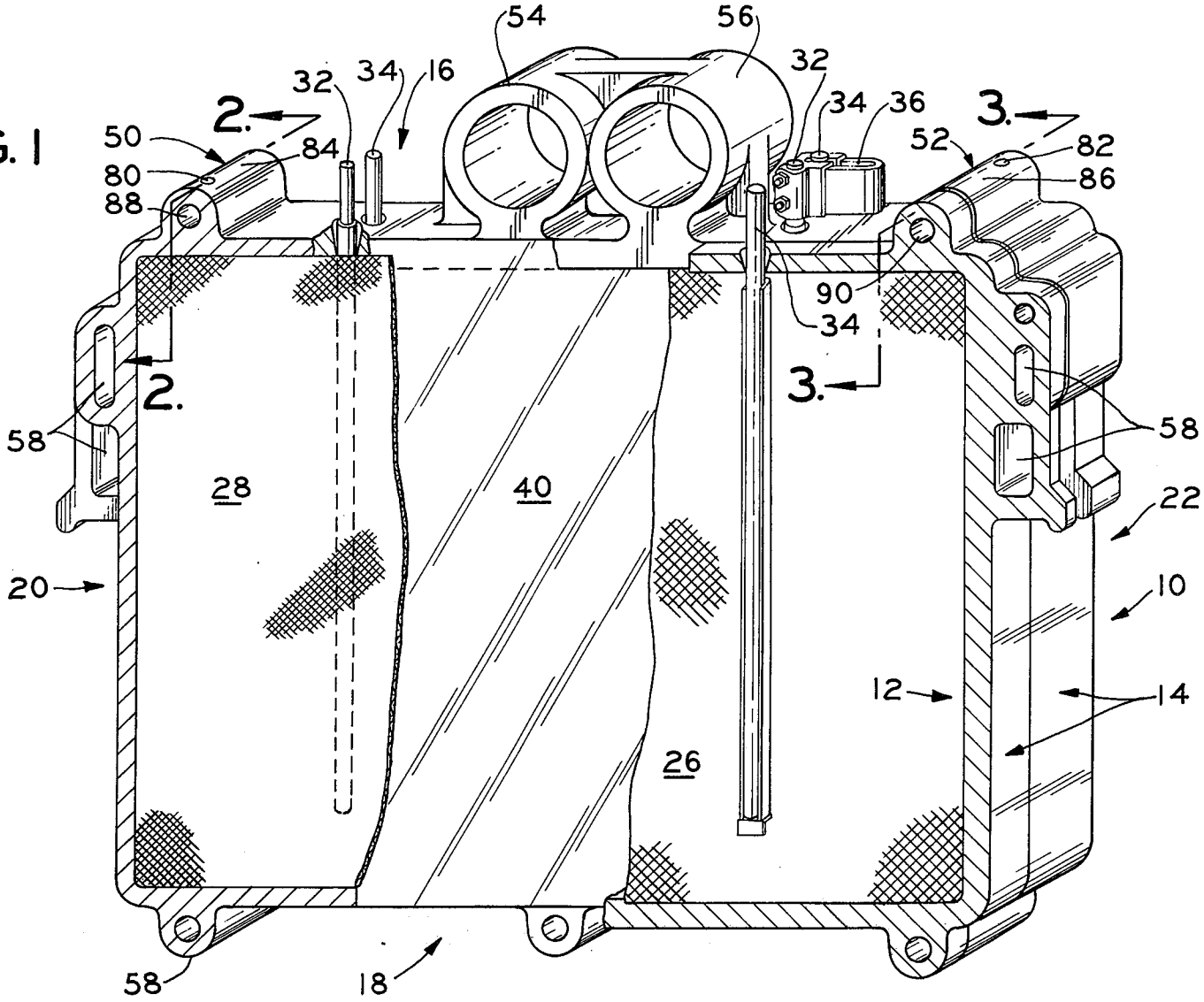
FIG. 1 is a perspective view in partial cross-section of a typical electrolytic cell structure in which the subject invention may be advantageously utilized.

Referring now to the drawings wherein the showings are for purposes of illustrating the preferred embodiment of the invention only and not for purposes of limiting same, the FIGURES show a pair of juxtapositioned cell modules 10, 12 (actually only one-half of module 12 is shown) each comprised of a frame generally designated 14. These frames may be constructed from any convenient material and, in the preferred embodiment, are molded from a plastic material such as polypropylene. Since the specifics of the frames themselves do not form a part of the present invention, they will only be described in general terms hereafter.

Accordingly, each frame has a top 16, bottom 18 and opposed sides 20, 22. A generally centrally disposed web 24 (FIGS. 2 and 3) divides each frame 14 into two separate portions in order that the desired electrolysis may be obtained. Disposed on one side of web 24 adjacent one outer edge of the frame is a cathode screen generally designated 26 and on the other side of web 24 adjacent the other outer edge of the frame is an anode screen generally designated 28. A pair of spaced apart anode conductor rods generally designated 32 are affixed to the anode screen 28 and protrude outwardly from frame 14 at top 16. Likewise, a pair of spaced apart cathode conductor rods 34 are affixed to cathode screens 26 and protrude outwardly of frame 14 at top 16. Because the cathode and anode screens 26, 28 of each module are electrically insulated from each other, flexible intercell connectors generally designated 36 are employed to interconnect the adjacent rods 32, 34 in each cell module. In the arrangement of FIG. 1, the flexible intercell connector is only shown on one side of the module although it will be appreciated that, in practical application, an intercell connector is employed on both sides.

The arrangement of FIG. 1 shows portions of a pair of juxtapositioned cell modules 10, 12 in partial cross-section. In each module, cathode and anode screens 26, 28 will be positioned closely spaced to anode and cathode screens 26, 28 of the two adjacent modules. A thin, permselective membrane 40 is placed between close spaced screens 26, 28 of adjacent modules as shown in FIG. 1. As shown in FIG. 1, anode screen 28 is part of module 10 and cathode screen 26 is a part of module 12 with the permselective membrane 40 being precisely and closely spaced therebetween. Normally, a whole series of modules 10, 12 are assembled on a frame and interconnected with each other to achieve the final desired overall cell structure.

Typically, frames 14 which are used for modules 10, 12 include first header members 50 and second header members 52. These headers run continuous along the length of the sandwiched modules and are employed to supply fluid or liquid to the separate anode and cathode compartments as will be hereinafter more particularly described. The source of supply or interconnection thereto is not shown since it will be known to those skilled in the art and does not form a part of the present invention. In addition, headers generally designated 54, 56 are typically incorporated to draw off gases produced during electrolysis and additional headers and/or mounting areas generally designated 58 are included and employed for drawing off the non-gaseous products of electrolysis, supplying additional materials to the interior of the modules and for assembling the individual modules into a closely spaced type structure. Since the above discussion is merely background of the environment to which the subject invention is deemed particularly applicable, further elaboration herein is not thought to be necessary. The assembly and operation of such cells are known to those skilled in the art and the above information and background is deemed sufficient for placing the subject invention in its proper perspective.

Figure 2:
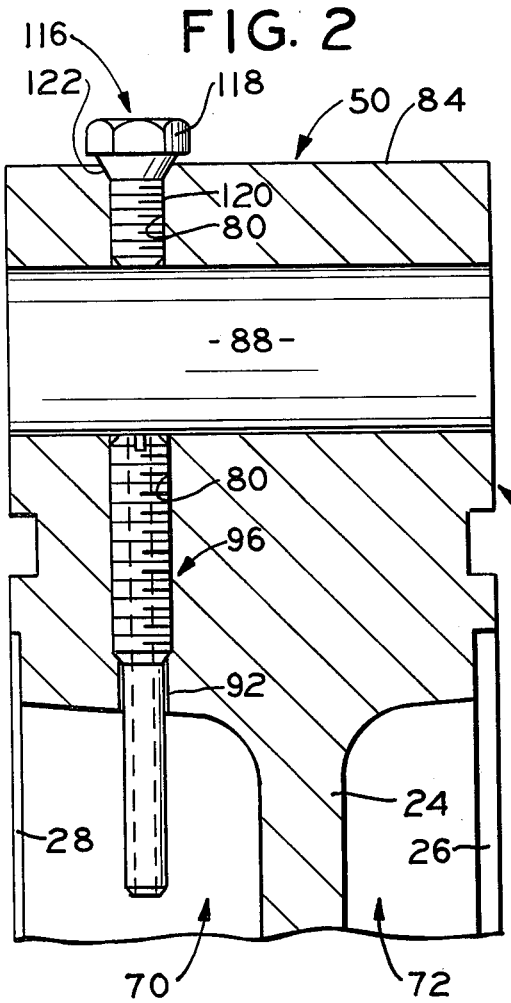
FIG. 2 is a cross-sectional view taken along lines 2—2 of FIG. 1.
Figure 3:
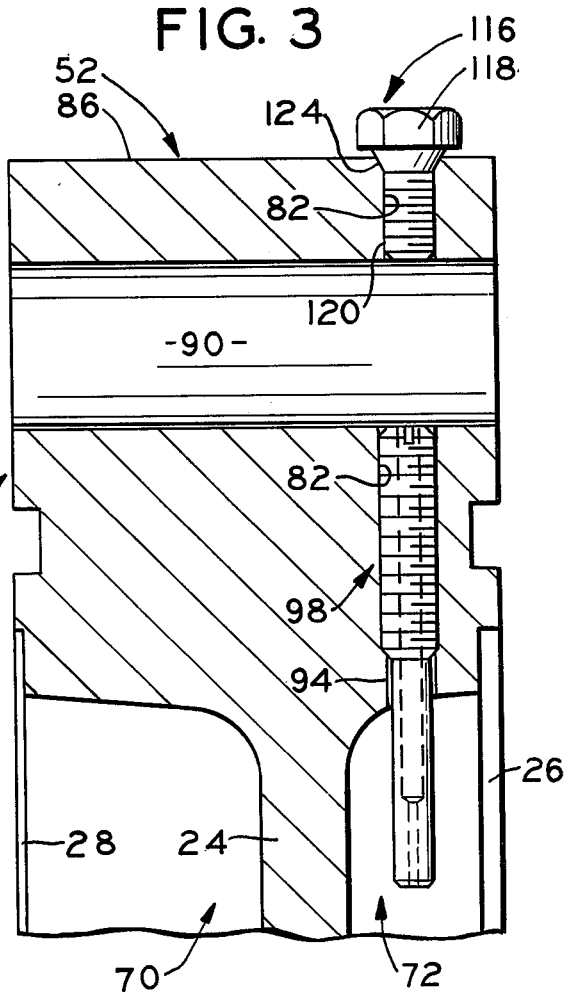
FIG. 3 is a cross-sectional view taken along lines 3—3 of FIG. 1.
Figure 4:
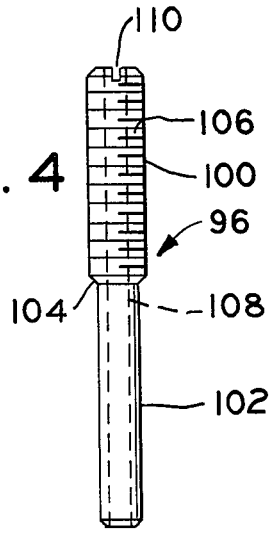
FIG. 4 is the removable orifice member used in conjunction with the anode compartment of FIG. 2; and, FIG. 5 is the removable orifice used in conjunction with the cathode compartment of FIG. 3.

Referring to FIGS. 2 and 3, screens 26, 28 and web 24 divide each frame 14 or module into a separate anode compartment generally designated 70 and a separate cathode compartment generally designated 72. A first aperture 80 passes through first header 50 and into anode compartment 70 and a second aperture 82 passes through second header 52 and communicates with cathode compartment 72. Each cell module includes one aperture 80 and one aperture 82. In FIG. 1, these apertures are shown for cell module 10 and the rest of the individual modules which are used in assembling a complete cell would have similar apertures. Aperture 80 extends inwardly from outermost surface 84 of first header 50 through bore 88 of that header and then into anode compartment 70. Likewise, aperture 82 extends from outer-most surface 86 of second header 52 through bore 90 of that header and then into cathode compartment 72. While in the preferred embodiment of the present invention, apertures 80, 82 are shown as being generally normally disposed relative to bores 88, 90, the apertures could be at other angles and/or lateral locations, as long as there exists unrestricted communication between the bores 88, 90 and the anode compartment 70 and cathode compartment 72, respectively, without departing from the intent and scope of the present invention. Apertures 80, 82 are conventionally threaded from outermost ends 84, 86 inwardly and continuously toward compartments 70, 72, respectively, such that a threaded member may simultaneously be engaged by both the threaded portion from the outermost surface 84, 86 to the bore 88, 90 and the threaded portion between the bore 88, 90 and the compartments 70, 72, respectively. Adjacent the lowermost ends of these apertures are unthreaded areas of reduced diameter generally designated 92, 94 which act as stop areas for removable orifice defining members as will be described hereinafter.

Receivable in apertures 80, 82 are first and second elongated orifice defining members 96, 98, respectively. Inasmuch as these members are substantially identical except for the size of the orifice passing therethrough, description will hereinafter be made with reference to member 96, it being appreciated that member 98 is identical thereto except as otherwise specifically noted. Member 96, comprising the first orifice defining member, has an elongated body portion 100 which merges into a reduced diameter elongated neck portion 102 at merger area 104. Body portion 100 includes conventional threads 106 thereon adapted to threadly mate with the threads of aperture 80. As shown in FIG. 2, body portion 100 is dimensioned to extend between reduced diameter area 92 of aperture 80 and the inner surface of bore 88 with merger area 104 acting as a member stop and neck portion 102 penetrating into anode compartment 70. In a preferred embodiment, the length of the threaded portion 100 of the orifice defining member 96 is greater than the diameter of the bore 88, so that the said threaded portion will be engaged by at least one of the threaded portions of the aperture 80 at all times during installation or removal. Thus, at no time during the installation or removal of said member 96 will said member be totally threadedly unattached from the aperture 80. The threading action will therefore be continuous and uninterrupted at all times, thus achieving positive installation and removal. A fluid orifice 108 extends longitudinally through member 96 in order that fluid passing through bore 88 may pass from the bore through orifice 108 into compartment 70. For purposes of installation and removal of member 96 by convenient tool means, a cross slot 110 is conveniently provided in the outer end surface of body portion 100. Of course, other means of installation and removal may be used, as will be recognized. For example, a recessed hexagonal or square opening to fit a similar allen wrench, or a head such as would engage a Phillips head screwdriver, may suitably be used, provided orifice 108 is not obstructed.

Figure 5:
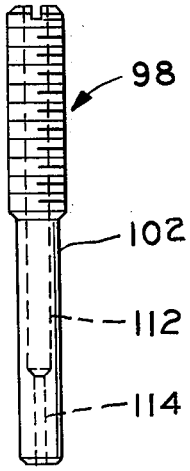

As noted above, second elongated orifice defining member 98 is substantially identical to member 96 hereinabove just described. However, as will be noted from FIGS. 3 and 5, orifice 112 passing longitudinally therethrough is multidimensional. That is, orifice 112 narrows into a smaller orifice 114 adjacent the lowermost end of neck portion 102. The relative diameters or orifice 112 and orifice 114 may of course be reversed, with the larger diameter orifice in the lowermost portion of the neck portion 102, if so desired. The differences in the dimension of orifices 108, 112 are merely for purposes of more precisely controlling fluid or liquid flow into anode compartment 70 and cathode compartment 72. In the preferred embodiment here under discussion, the cell is contemplated for use in producing chlorine and caustic and the fluid passed through bore 88 and thence into anode compartment 70 is brine and the fluid passed along bore 90 and thence into cathode compartment 72 is water. However, the concepts of the subject invention need not be limited to this use or structure since they are merely preferred in describing the invention. While members 96, 98 may be constructed from any convenient material, the preferred arrangement here under discussion contemplates use of chlorinated polyvinyl plastic.

For purposes of closing apertures 80, 82, end caps generally designated 116 in FIGS. 2 and 3 are provided. Each end cap has an enlarged head portion 118 and a threaded shank portion 120 adapted to be threadedly received by the uppermost portion of both apertures 80, 82. The inner face between the head and shank portions may be beveled so as to be snuggly received in countersunk areas 122, 124 in apertures 80, 82, adjacent outermost surfaces 84, 86, respectively. This merely helps in assuring that a fluid tight relationship will be obtained between the caps and apertures to prevent leakage from bores 88, 90. Additionally, it should be noted that the lengths of shank portions 120 are such that they do not extend into bores 88, 90 to interfere with fluid or liquid flow therethrough.

The advantages obtained when using the concepts of the subject invention are that orifice defining members 96, 98 are easily removable, without danger of disengagement and loss, from within frames 14 to facilitate cleaning or replacement as may be necessary. Accordingly, and in order to remove a typical one of the members once fluid flow through the associated header has been stopped, it is merely necessary to first unthread and remove end cap 116 and insert a conventional screwdriver or other convenient tool into aperture 80 or 82 from outermost surface 84 or 86 into engagement with cross slot 110. Thereafter, the orifice defining member may be continuously unthreaded along its associated aperture and out through the top end thereof at surface 84 or 86. Such removal for purposes of cleaning the orifice or replacing the entire member is sometimes frequently required because the nature of the fluids or liquid material passed through the orifices into compartments 70, 72 has a propensity to clog the orifices and impair efficient overall operation of the cell. Reinstallation of members 96, 98 is just the opposite from that described hereinabove with regard to removal. Thus, the subject invention eliminates the need for complicated and time consuming orifice cleaning techniques which have heretofore been required. Also, the subject invention has eliminated the necessity for tearing down or otherwise dismantling the overall cell structure for purposes of gaining access to the orifices themselves. It will also be appreciated that the orifices are important to efficient cell operation inasmuch as the fluid or liquid is passed therethrough into compartments 70, 72 in order that the desired electrolysis may be achieved.

The invention has been described with reference to the preferred embodiment. Obviously, modifications and alterations will occur to others upon the reading and understanding of the specification. All such modifications and alterations are intended to be included insofar as they come within the scope of the appended claims or the equivalents thereof.

It is claimed:

1. In an electrolytic cell which includes at least a pair of juxtapositioned cell modules, each module including a housing having an anode and a cathode disposed thereon and establishing separate anode and cathode compartments separated by a fluid impermeable web member, said housing further including a first header for supplying fluid to said anode compartment and a second header for supplying fluid to said cathode compartment, wherein the improvement comprises:

said housing having a first aperture communicating between said first header and said anode compartment and a second aperture communicating between said second header and said cathode compartment; and, a first member having a first fluid orifice therein positioned in said first aperture and a second member having a second fluid orifice therein positioned in said second aperture for metering fluid flow into said anode and cathode compartments from said first and second headers, respectively, wherein said first and second members each include a body portion releasably threadedly retained in said first and second aperture and a neck portion penetrating said anode and cathode compartments, respectively.

2. The improvement as defined in claim 1 wherein both said apertures include threads over a longitudinal portion thereof and the outside surfaces of said body portions include threads over at least a section thereof for mating threaded interconnection with the threads of said first and second apertures.

3. The improvement as defined in claim 2 wherein each of said first and second members includes a slot-like area in the outermost end of said body portions adapted to receive a tool passed into said first and second apertures from the outermost ends thereof for purposes of installing and removing said first and second members therein.

4. The improvement as defined in claim 1 wherein said first aperture extends from the outermost surface of and generally transversely through said first header into said anode compartment and said second aperture extends from the outermost surface of and generally transversely through said second header into said cathode compartment, said housing further including means for selectively closing said first and second apertures at said outermost surfaces of said headers.

5. The improvement as defined in claim 4 wherein said closing means comprises cap members adapted to be releasably received in said first and second apertures from said outermost surfaces of said first and second headers.

6. The improvement as defined in claim 4 wherein said first and second members are threadedly received in said first and second apertures, said first and second members further including tool receiving means therein adapted to receive a tool and facilitate member removal of said members from said apertures.

7. In an electrolytic cell for the production of alkali metal hydroxide wherein at least a pair of juxtapositioned cell modules are provided having a permselective membrane member positioned therebetween, each of said cell modules including a housing having an anode and a cathode disposed thereon and establishing separate anode and cathode compartments separated by a fluid impermeable web member, said housing further including a first fluid supply header for supplying a first fluid to said anode compartment and a second fluid supply header for supplying a second fluid to said cathode compartment, the improvement comprising:

said housing having a first aperture passing generally transversely through said first header and communicating with said anode compartment and a second aperture passing generally transversely through said second header and communicating with said cathode compartment; a first member received in said first aperture and having a first through orifice therein communicating between said first header and said anode compartment; a second member received in said second aperture and having a second through orifice therein communicating between said second header and said cathode compartment whereby fluid flow into said anode and cathode compartments may be metered through said first and second orifices; wherein each of said first and second members includes a body portion adapted to be releasably threadedly retained in said first and second apertures and a neck portion penetrating said anode and cathode compartments, respectively; and a means for closing the outermost ends of said first and second apertures.

8. The improvement as defined in claim 7 wherein said first and second members are elongated with said first and second orifices passing generally longitudinally therethrough.

9. The improvement as defined in claim 7 wherein said first and second members each include means to facilitate selective positive removal of said members from said first and second apertures.

10. The improvement as defined in claim 7 wherein both said apertures include threads over a longitudinal portion thereof and the outside surfaces of said body portions include threads over at least a section thereof for mating threaded interconnection with the threads of said first and second apertures.

11. The improvement as defined in claim 10 wherein each of said first and second members includes a slot-like area in the outermost end of said body portion adapted to receive a tool passed into said first and second apertures from the outermost ends thereof for purposes of installing and removing said members therein.

12. The improvement as defined in claim 7 wherein said closing means comprises cap members adapted to be releasably received in said first and second apertures from the outermost ends thereof.

* * * * *